US008451202B2

(12) United States Patent
Kashi

(10) Patent No.: US 8,451,202 B2
(45) Date of Patent: May 28, 2013

(54) DISPLAY ASSEMBLY THAT USES PIXEL-LEVEL MEMORY CELLS TO RETAIN AND DISPLAY PARTIAL CONTENT

(75) Inventor: Mostafa Kashi, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1484 days.

(21) Appl. No.: 12/042,915

(22) Filed: Mar. 5, 2008

(65) Prior Publication Data

US 2009/0225004 A1 Sep. 10, 2009

(51) Int. Cl.

| | |
|---|---|
| ***G09G 3/36*** | (2006.01) |
| ***G09G 3/00*** | (2006.01) |
| ***G09G 3/20*** | (2006.01) |

(52) U.S. Cl.
USPC ..... 345/90; 345/30; 345/55

(58) Field of Classification Search
USPC ..... 345/30, 55, 90, 98, 100, 211, 501, 345/522
See application file for complete search history.

(56) References Cited

U.S. PATENT DOCUMENTS 5,945,972 A * 8/1999 Okumura et al. ..... 345/98
7,256,788 B1 * 8/2007 Luu et al. ..... 345/501

* cited by examiner

*Primary Examiner* — Srilakshmi K Kumar

(57) ABSTRACT

A display assembly may include a plurality of pixel elements, of which a set of pixel elements include both a display cell and a memory cell. The display cell and the memory cell may be connected to receive data from a common source at the same time.

11 Claims, 5 Drawing Sheets

DISPLAY ASSEMBLY THAT USES PIXEL-LEVEL MEMORY CELLS TO RETAIN AND DISPLAY PARTIAL CONTENT

TECHNICAL FIELD

The disclosed embodiments relate to display assemblies for computing devices. In particular, embodiments described herein provide a display assembly that uses pixel-level memory cells to retain and display partial content on a mobile or other computing device.

BACKGROUND

Over the last several years, the growth of cell phones and messaging devices has increased the need for display functionality and performance. When considering the battery life of a mobile computing device, for example, the display assembly of the device is often a primary power drain, requiring refresh of its pixel data at various rates (e.g. 60 cycles per second). With these constraints, conventional battery power conservation techniques have focused on reducing power consumption by intelligently switching the display assembly off. Alternative conventional approaches have relied on turning the backlight of the display assembly off.

The use of mobile computing devices has increasingly become constant amongst some users. These devices are increasingly recognized for their ability to keep accurate time, provide useful information, or incorporate personalization (e.g. family pictures). These additional usages, which can sometimes act as fillers between sessions when the user is actively using the device, increase the role of the device in the user's life. Still further, some devices currently switch the display assembly off when the device is in active use, in anticipation of the user not needing the display. For example, some computing devices switch the computing device off when the user is using the device as a handset, presumably because instances of such usages, the user cannot see the display assembly.

In any scenario where the display assembly of a computing device is switched off, the user must perform some action like a button press to switch the display assembly back on. The display assembly is typically switched all the way back on, thus draining the battery supply, even when the user simply wants to view the time.

DETAILED DESCRIPTION

Figure 1:
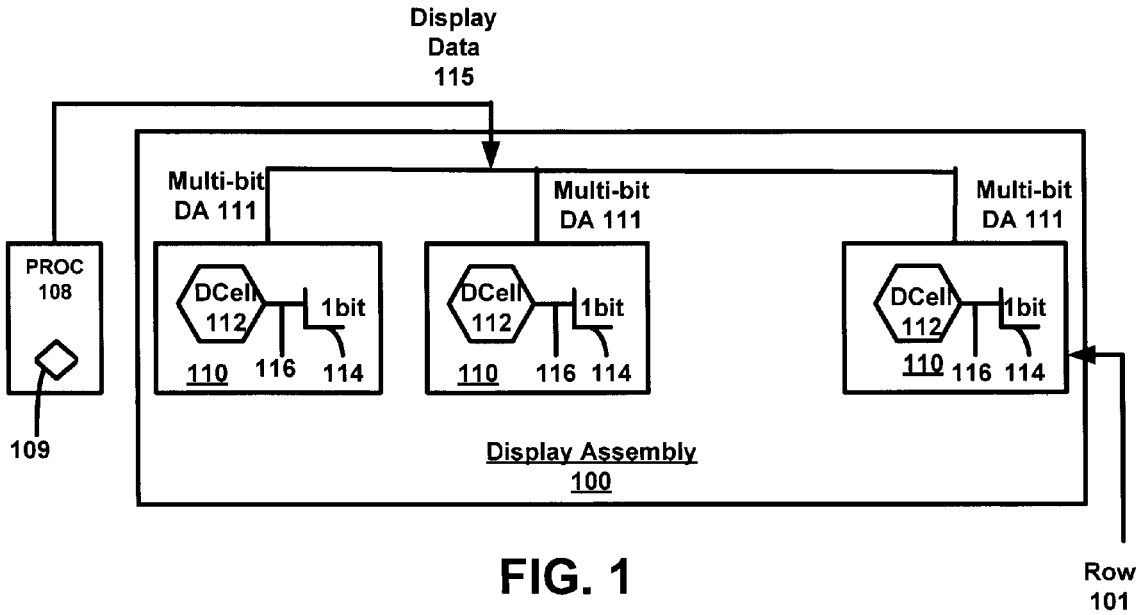
FIG. 1 is a simplified representation of a display assembly, according to an embodiment.

One or more embodiments include a display assembly for a computing device. The display assembly may include a plurality of pixel elements, of which a set of pixel elements include both a display cell and a memory cell. The display cell and the memory cell may be connected to receive data from a common source at the same time.

One or more embodiments described herein provide for operating a display on a computing device. In an embodiment, the display may be operated by illuminating an array of pixel elements. The illuminating of the pixel elements may include refreshing the individual pixel elements at multiple instances per a given duration using display data. Simultaneously, with refreshing individual pixel elements at a given one of the multiple instances, at least some of the display data may be stored on individual pixel-level memory cells. These cells may be provided as part of a set of the pixel elements that are included in the array. Performance of refreshing the individual pixel elements may cease, at least for the given duration. On cessation, data stored in the pixel-level memory cell of individual pixel elements may be used to generate light variations from at least some of the pixel elements in the set of pixel elements that have such memory cells.

Embodiments described herein enable display illumination when the display is both in a high and low operational state. According to an embodiment, when the display is in a high operational state, individual pixel elements that comprise the display are illuminated by refreshing the individual pixel elements using display data. Such refresh operations may occur at multiple instances per second. For each pixel element in a set of pixel elements that comprise the array and which include a pixel-level memory cell, at least some of the display data may be simultaneously stored with the pixel-level memory cell of that pixel element. In response to detecting that the display is switched from the high operational state into a low operational state, data stored in the pixel-level memory cell of that pixel element is used to illuminate that pixel element.

Still further, another embodiment provides a display assembly for a computing device. A display assembly may include an array of pixel elements and a display control resource (such as a row or column driver). Individual pixel elements of the array include a display cell. The display control resource that is configured to temporarily hold data for refreshing each of the pixel elements of the array. At least a subset of pixel elements include or are provided a pixel-level memory cell for that pixel element along with the display cell. Additionally, the display control resource is configured to signal refresh of individual pixel elements in the array, including the display cell and the pixel-level memory cell of each pixel element in the set, at each of multiple instances in a given duration.

As used herein, the use of the term "operational state" includes consideration of data driving operations and optionally illumination. In a high operational state, data is driven to the pixel elements of the display at numerous instances per second (i.e. refresh operations). In a low operational state, such refresh operations are eliminated or greatly reduced.

The term "simultaneously" in the context of two events, for example, is intended to includes substantially simultaneously or nearly simultaneously. For example, some differences between the timing of two events may exist because of manufacturing tolerances, but the events may still be viewed as being simultaneous.

As used herein, the "display control resource" includes a combination of memory and logic that can receive and hold display data, and control refresh of pixel elements in an array of pixel elements. A display control resource may be implemented with, for example, a column driver.

It should be noted that the term "illuminate' or 'illuminating' does not mean through the use of backlighting, but rather includes any light variation that is made through triggering individual pixel elements (or their display cells) to output a hue or other form of light variation. Thus, reference to illuminating a pixel element is independent of backlighting that pixel element, but rather indicative of the element being strobed with data to create light variations.

Overview

FIG. 1 is a simplified representation of a display assembly, according to an embodiment. A display assembly 100 is comprised of a plurality of pixel elements 110, of which each include a display cell 112. At least some (if not all) of the pixel elements 110 include an embedded or pixel-level memory cell 114. The pixel-level memory cell 114 is distributed to be provided with the individual pixel element. In an embodiment, (i) the memory cell 114 of an individual pixel element carries data only for that pixel element, and (ii) the memory cell 114 is co-located on the pixel element, so as to be physically adjacent the display cell 112, or otherwise provided in proximity or on the same path as the display cell 112 of that same pixel element 110. In one embodiment, the pixel-level memory cells 114 are positioned to receive data written to the corresponding pixel-element synchronously or nearly simultaneously, with each refresh operation.

With reference to FIG. 1, the plurality of pixel elements 110 that are shown may form at least a portion of a row 101 of the pixel array that is provided for the assembly 100. When the display assembly 100 is operated in a high (or operational) power state, the plurality of pixel elements 110 receive data written from a processing resource on a continual basis. Specifically, a processing resource may write data to continuously illuminate the pixel elements 110, with refresh being performed at multiple instances per second (e.g. 60 instances per second for each pixel element). Under a normal operative state (i.e. a high operational state), each pixel element 110 is illuminated using a multi-bit data set 111, such as a 16 or 24 bit data set, which may be written for individual pixel elements at each instance when the display write or refresh operation is performed. The data set may represent, for example, red-green-blue (RGB) values which are received by control elements of individual pixel elements and then illuminated through material or structure of the display cell 112.

In the simplified illustration provided, a processing resource 108 may perform write or refresh operations 109 to write display data 105 to illuminate the individual display cells 112 of the display assembly 100. As described with an embodiment of FIG. 4A, for example, display data 105 may be written to one or more display memory resources. As described with an embodiment of FIG. 4, for example, a column driver 410 may temporarily store that is subsequently used to simultaneously (i) illuminate the display cells 112 of individual pixel elements, and (ii) to populate the pixel-level memory cell 114 of individual cells at the same time. The display data 115 may include the multi-bit data set 111, used to illuminate individual display cells 112 with, for example, various values of red, green and blue.

In each pixel element 110 of the set, the embedded or pixel-level memory cell 114 is aligned to continuously store data that is a subset of the data being used to illuminate the display cell. In this way, the memory cell 114 always contains fresh data. At each instance, (i) a data set is used to illuminate the display cell 112, and (ii) one or more bits from that data set are stored in the pixel-level memory cell 114. In this way, the pixel-level memory cell 114 holds data that is refreshed at each instance, in that the data is stored synchronously (or parallel in time) with the data set generated from the refresh operations performed to illuminate the display cell 112. In an embodiment, the memory cell 114 holds a single bit from the multi-bit data set that is written to the pixel element 110. Thus, with each refresh operation, the memory cell 114 holds one bit from that operation.

In an embodiment, the pixel elements 110 that include the pixel-level memory cell 114 may include a triggered connection 116 (such as provided by a gate) that enables the display cell to use data stored in the memory cell 114 in response to one or more conditions. According to one embodiment, the triggered connection 116 may operate to switch the pixel element 110 (e.g. its control element) from receiving the data set 111 from the processing resource 108 to retrieving or otherwise using the data from the co-located or embedded memory cell 114 when the processing resource stops writing data to the display assembly. The triggered connection 116 may be responsive to conditions such as may occur when the device or display assembly 100 is switched "off", meaning into a low power (but partially operative state, or in a standbye state). The triggered connection 116 may be configured to switch with the display assembly 100 as a whole being provided high or low voltage for its respective power state.

In the low operational state, the display cell 112 retrieves and/or uses the data stored in the memory cell 114. In an embodiment, the data stored in the memory cell 114 is stored from the data set 111 that was written to that pixel element 110 in the last instance of the refresh operation performed by the processing resource 108, just before the change in the state of the display assembly 100. The display cell 112 may display that data without refresh.

Methodology

Figure 2:
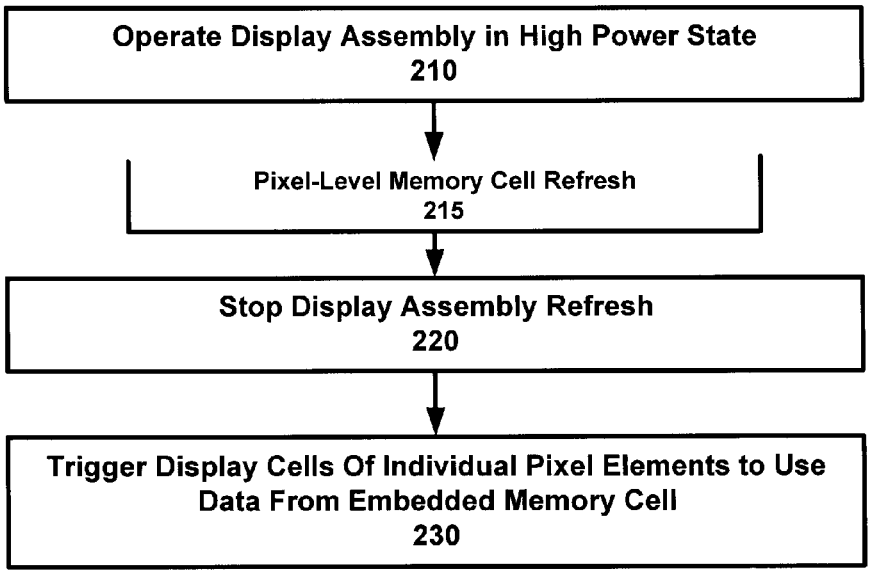
FIG. 2 illustrates a technique or method for using pixel-level memory cells to store portions of recent or fresh data for display of information when the display assembly is in a low operational state, under an embodiment of the invention.

FIG. 2 illustrates a technique or method for using pixel-level memory cells to store portions of recent or fresh data for display of information when the display assembly is in a low operational state, under an embodiment of the invention. In describing an embodiment of FIG. 2, reference may be made to elements such as described with an assembly of FIG. 1, or with other elements herein. Such reference is intended to illustrate suitable elements or components for implementing a step or sub-step being described.

In a step 210, display assembly 100 is operated in a high operational state. This may correspond to a normal operative state of the display assembly, where its pixel elements 110 are all used to display information and content. In the high operational state, data is continuously refreshed for each of the individual pixel elements 110. For example, under many conventional approaches, each pixel element 110 receives data from a processing resource as part of a write/refresh operation a rate that is typically in the range of 60 instances per second.

As a sub-step 215, in the high operational state, at least some of the pixel elements carry memory cells 114 which receive and store a portion of the data set that is written to illuminate the pixel element at a given instant. In this way, the memory cells 114 have data continuously written/refreshed in parallel (or at least nearly simultaneously) with data used to illuminate the display cells 112 of that element. Thus, at any given instance, the memory cell 114 stores one or more data bits that are received from the most recent write/refresh operation of the processor.

In step 220, the display assembly may cease to receive data provided by the processing resource's refresh operations. This may occur when, for example, the display assembly 100 is switched into the low operational state (i.e. 'off') as a result of non-use (e.g. programmatic timeout).

When this occurs, an embodiment provides that in step 230, the triggered connection 116 of the pixel element 110 enables the pixel element 110 to switch to using data from the embedded memory cell 114 of that pixel element 110. This step may be performed simultaneously with the refresh of the display assembly being stopped. The data of the memory cell 114 may be small in size, such as reflected by a single bit. This eliminates the need for refreshing the pixel element 110.

One application for an embodiment such as described is that some pixel elements, representing, for example, a portion of the display surface of the display assembly, may display content corresponding to a low resolution image. As a specific example, a coarse black and white image or piece of information may be displayed, representing the last item of content that the particular pixel element displayed before the switch in the power state of the display assembly 100.

Pixel Element

Figure 3:
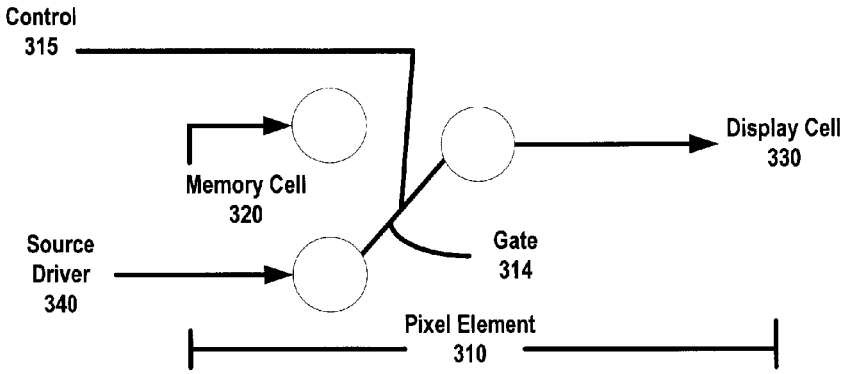
FIG. 3 illustrates a pixel element, in accordance with one or more embodiments described herein.

FIG. 3 illustrates a pixel element, in accordance with one or more embodiments described herein. With reference to an embodiment of FIG. 3, a pixel element 310 includes a memory cell 320, and a display cell 330, which collectively are driven by a source driver 340. The source driver 340 may be positioned to supply multi-bit data set from a processing resource when the larger display assembly is operated in the high operational state. Absent occurrence of a condition such as the display assembly switching off, the display cell 330 uses multi-bit data from the source driver 340. The memory cell 320 may be positioned to receive data from the source driver 340 at the same time, or at least nearly simultaneously, with the display cell 330 being illuminated to create light variations. In an embodiment, the memory cell 320 may be connected to receive only select bits of the overall data set that is provided to the individual display cell 330. In one embodiment, for example, the memory cell 320 receives a single bit from every multi-bit data set that is communicated for the display cell 330 from over the source driver 340.

When the write operations cease (in response to occurrence of conditions such as the display assembly being powered down), an embodiment provides that the triggered connection, in the form of a gate 314, may switch the source of the data to the display cell 330 from the source driver 340 to the memory cell 320. Thus, the display assembly may be switched into a stand-bye or low operational state, in which case the individual pixel element 310 is no longer being refreshed from the processing resource. The gate 314 may switch in response to a change in the voltage, provided as control 315. The control 315 may be provided to the display assembly in connection with the switch to the low operational state. With the triggering of gate 314, the display cell 330 uses data stored in the memory cell to provide a single or low bit display value. Other pixel elements in the same display may similarly be used to create a granular or low resolution image, such as in the form of monochromatif image. It should be noted that with advances in memory cell technology and costs, the ability to carry additional data bits in individual memory cells may improve the granularity of overall image that can result from the use of the stored data in the pixel-level memory cells.

Figure 4A:
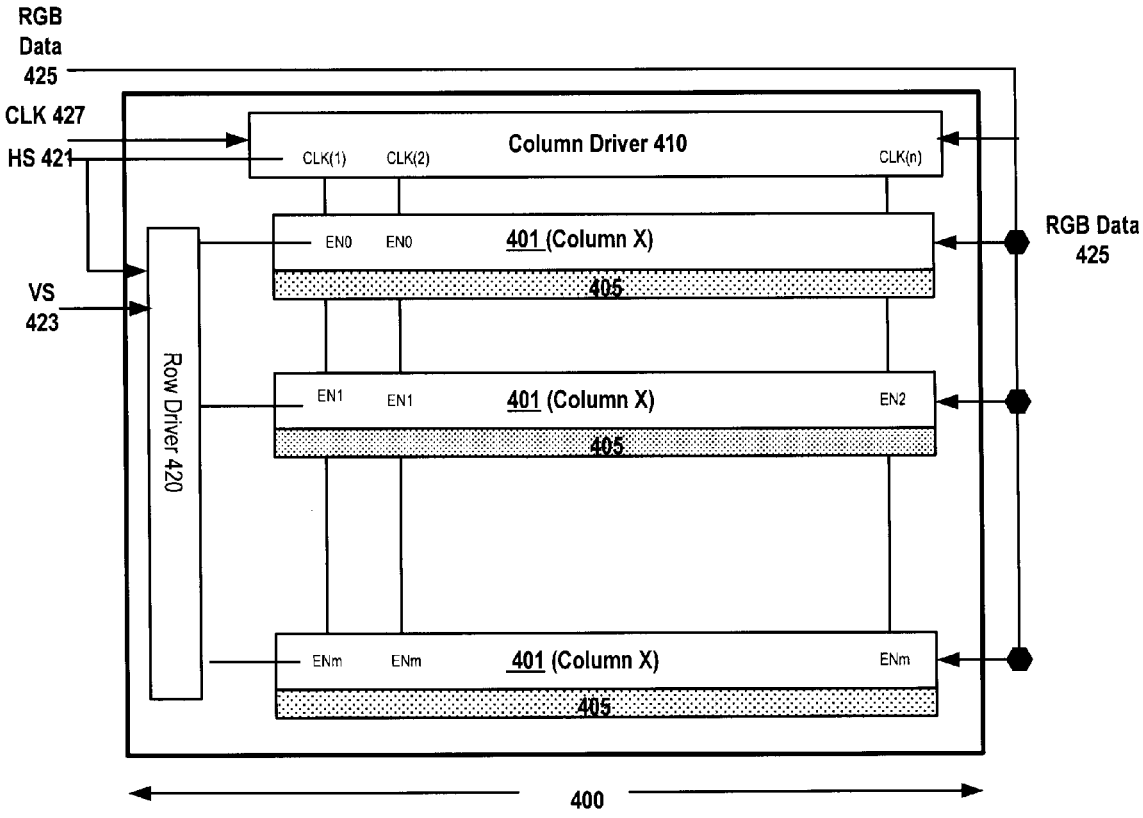
FIG. 4A illustrates a use of column driver to write data to an array of pixel elements that form a display assembly for a computing device, where the display-assembly includes pixel-level embedded memory cells.
Figure 4B:
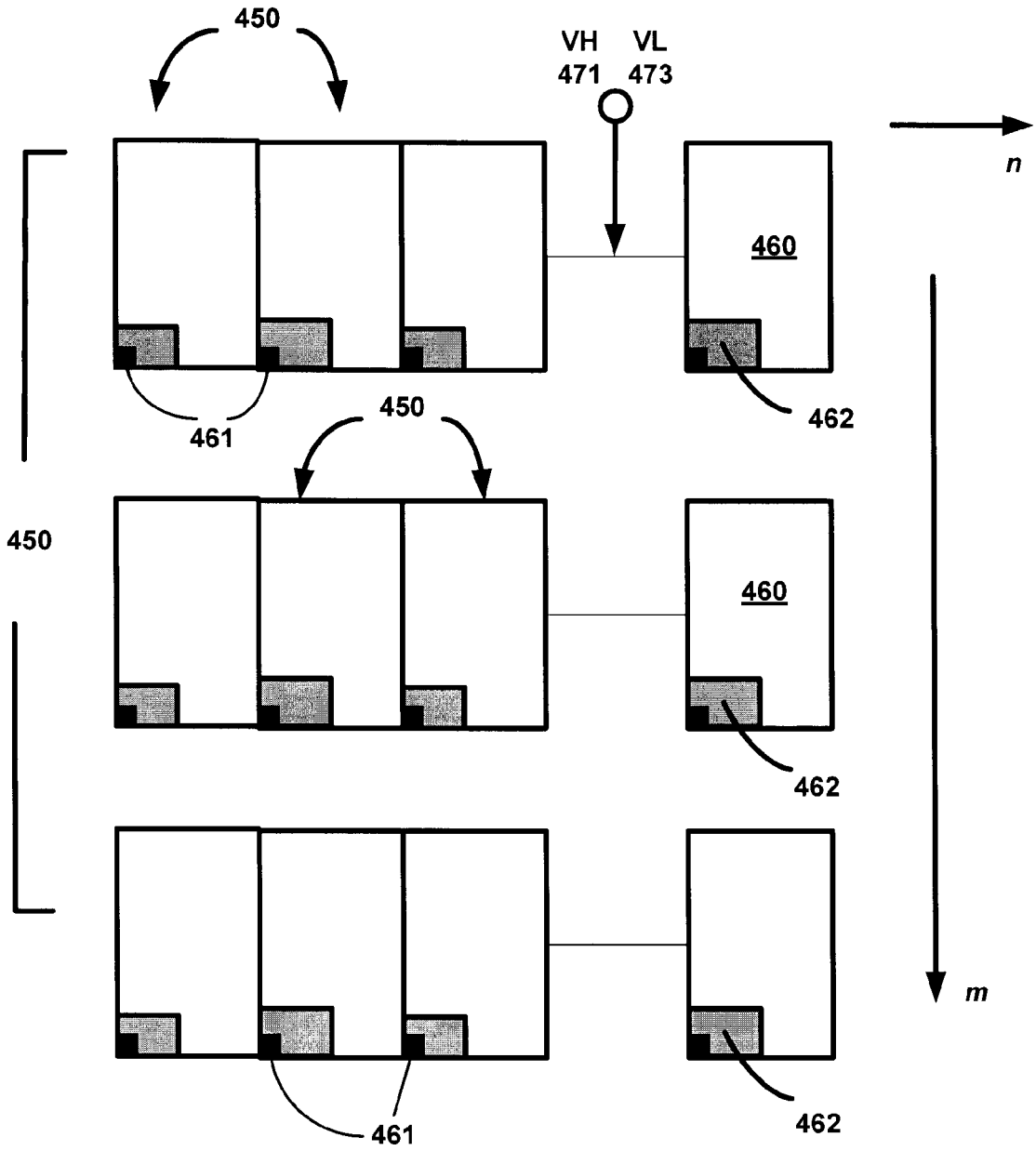
FIG. 4B is a simplified view of the array of pixel elements that form the display assembly, showing incorporation of the pixel-level memory cells, under an embodiment of the invention.

FIG. 4A illustrates a use of column driver 410 to write data to an array of pixel elements that form a display assembly for a computing device, where the display-assembly includes pixel-level embedded memory cells. FIG. 4B is a simplified view of the array of pixel elements that form the display assembly, showing incorporation of the pixel-level memory cells, under an embodiment of the invention.

Similar to conventional approaches, the display assembly 400 includes a column driver 410 and a row driver 420. The row driver 420 may operate in conjunction with a horizontal sync signal 421 and a vertical sync signal 423. The column driver 410 may operate with the horizontal sync signal 421. In an embodiment, a display control resource is embedded or otherwise provided with the column driver 410 to enable signaling of data written from the processor. The operations of the column driver 410 enable signaling of refresh operations using such data. In an embodiment, the column driver 410 may load display data (e.g. RGB data 425) into each row 401 of pixel elements 450 (FIG. 4B). As will be described, individual rows of pixel elements include corresponding rows 405 of pixel-level memory cells. When the column driver 410 provides data to rows 401 of pixel elements (individual rows being selected by the row driver 420), data is simultaneously written and stored in the rows of pixel-level memory cells 405.

The data for each pixel element of the row may be provided using the clock signal 427. In one implementation, the data is written to one row 401 of pixel elements during a period that is dictated by the horizontal sync signal 421. On completion of data written to one row, the data in the next row of pixel elements is strobed by the row driver 420. The vertical sync signal 423 operates at a frequency that determines the refresh rate of the display assembly. The data for the pixel elements are latched and sequenced in the column driver 410 until reloaded or refreshed again.

In one implementation, the column driver 410 is configured to temporarily store display data for a row of the array. The display data 425 may be received by the column driver 410 and then strobed to individual pixel elements of a given row in combination with operation of the row driver 420. When the display assembly is in a high operational state, the column driver 410 may be configured to continuously receive display data in refresh operations, where the data can then be distributed in a timed manner to the individual pixel elements in conjunction with the operation of the row driver 420. The data initially stored in memory resources of the column driver 410 may be used to refresh a given row 401 of pixel elements by providing control elements of the individual pixel elements 450 (described with FIG. 4B) data sets (e.g. 16 or 24 bits) from which light variations and illuminations may occur. As will be described, pixel elements carrying pixel-level memory cells may use data refreshes to simultaneously store data on that pixel element. As part of some or all of the pixel elements in a row 401, the pixel level memory cells may form their own row 405 of memory cells. In the high operational state, the refresh operations may be performed at numerous instances per second. In this respect, the column driver 410 (in combination with the row driver 420) may refresh data for rows 401 of pixel elements and rows 405 of pixel-level memory cells simultaneously.

With reference to FIG. 4B, each pixel element 450 may be comprised of liquid crystal material forming its display cell 460. Additionally, individual pixel elements 450 include a pixel control area 461. Each pixel element 450 may form only a portion of an overall pixel. For example, each pixel element 450 may represent one of a red, blue or green component of a pixel. The pixel control area 461 may be formed from, for example, thin-film transistor material, so as to include transistors and trace elements. In an embodiment, at least some of the pixel elements 450 in individual rows 401 include the embedded or pixel-level memory cells 462 integrated with the corresponding pixel control areas 461. In one embodiment, data strobed from the column driver 410 (FIG. 4A) is received by the respective pixel control areas 461 of pixel elements in each row, and then simultaneously stored in the pixel-level memory cells 462 while being used to illuminate and create light variations of the display cells 460 of the respective pixels. In an embodiment, the memory cells are added elements of the pixel control area 461.

As shown, the display cell 460 of each pixel element 450 may illuminate in relation to the value or data set that is written to the corresponding memory cell from the column driver 410 (FIG. 4A). Thus, the embedded memory cell stores data that forms a portion of the overall data written to the pixel control area 461 of the corresponding pixel element 450.

In a high operational state, all of the display cell 460 illuminates using the data set that is written to the control area 461 of the column driver 410 (FIG. 4A) or other display control resource. The illumination of the display cell 460 occurs at a rate of, for example, 60 times per second. A voltage 471 may be applied to the array 450 to enable the illumination and operation in the high operational state.

In a low operational state, some or all of the display cells 460 illuminate using the portion of the data set (e.g. the most significant data bit) that was stored in the pixel-level memory cells 462 of the individual pixel elements. A voltage 473 (which may be the same or less than the voltage 471 of the high operational state) may be applied to the array 450 to enable the illumination and operation of the pixel elements in the low operational state. In contrast to the high operational state, the refresh of the array 450 is eliminated, or at least greatly reduced. One possible benefit or result from an embodiment such as described is the ability to illuminate some or all of the display cells 460 of the array 450 even when the device is in the so-called off-state.

Some embodiments described herein provide a display control resource in the form of column driver 410. As described with column driver 410, the display control resource may include memory for temporarily storing data from which refresh of pixel elements may be signaled. Still further, as described with the column driver 410, the display control resource may include structure to enable it to communicate and receive data written for the display (i.e. array of pixel elements) from the processing resource. While an embodiment of FIG. 4A and FIG. 4B provides for the column driver 410 to provide signaling of data for refreshing of pixel elements, some or all of such functions described with the column driver 410 may be performed by other implementations of a display control resource. For example, other drivers, registers, control logics, or embedded combinations thereof, may be used to perform embodiments such as described.

Figure 5:
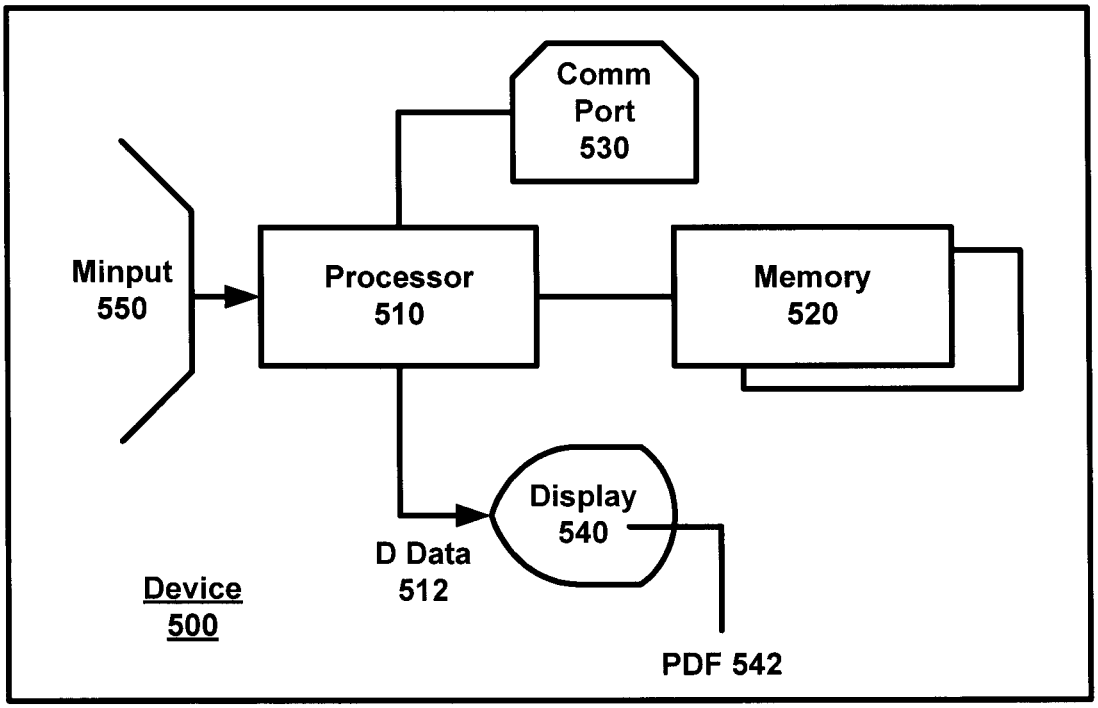
FIG. 5 provides a hardware diagram of a computing device, configured to include features such as described with any other embodiment provided herein.

FIG. 5 provides a hardware diagram of a computing device, configured to include features such as described with any other embodiment provided herein. In general, embodiments described herein may apply to numerous kinds of mobile or small form-factor computing devices. One type of mobile computing device that may be configured to include embodiments described herein includes a mobile telephony computing device, such as a cellular phone or mobile device with voice-telephony applications (sometimes called "smart phone"). A computing device such as described may be small enough to fit in one hand, while providing cellular telephony features in combination with other applications, such as messaging, web browsing, media playback, personal information management (e.g. such as contact records management, calendar applications, tasks lists), image or video/media capture and other functionality. Mobile computing devices in particular may have numerous types of input mechanisms and user-interface features, such as keyboards or keypads, multi-directional or navigation buttons, application or action buttons, and contact or touch-sensitive display screens. Specific types of messaging that may be performed includes messaging for email applications, Short Message Service (SMS) messages, Multimedia Message Service (MMS) messages, and proprietary voice exchange applications (such as SKYPE). Still further, other types of computing device contemplated with embodiments described herein include laptop or notebook computers, ultra-mobile computers, personal digital assistants, and other multi-functional computing devices.

The device 500 includes one or more processors 510, memory resources 520, a communication port 530, a display assembly 540, and one or more mechanical input features 550. The processor 510 may provide the processing resource to provide the display data 512 to the display assembly 540. The display assembly 540 may be configured in accordance with any of the embodiments described herein. As illustrated, display assembly 540 includes a partial display feature 542, provided by memory in pixel elements that combine to provide most recently refreshed data when the refresh operations from the processor 510 cease. Still further, the display assembly 540 may be touch or contact sensitive, so as to receive input from user contact or touch.

In an embodiment, the device 500 may correspond to a cellular telephony device, such as a smart phone or mobile manager, capable of cellular telephony, messaging, and data exchange. Alternatively, the device 500 may be any kind of computing device, such as a laptop computer, light computing device, or desktop computer. Embodiments such as described enable the device 500 to provide display content or information without use of refresh operations, which otherwise reduce battery power of the device.

Among other features, the communication port 530 may be configured to provide wireless connectivity of a particular type (or types). For example, the communication port 530 may correspond to a WAN radio module for sending and receiving cellular voice/data, a local wireless communication port such as Bluetooth or wireless USB, an infrared port, a Global Positioning System radio, or a WiMAX radio.

The memory resources 520 may include Flash memory, Random Access Memory, and/or persistent memory (i.e. ROM). The memory resources 520 include instructions and data for implementing functionality and programmatic actions such as provided with any of the embodiments described. Additionally, the memory resources 520 may carry databases or data stores of records that contain active data items (such as described above), and/or enable actions on such data items of saving the data items. The display 540 may render the data items described with any embodiment herein in an active state (e.g. as a link). The mechanical input mechanisms 550, which may include buttons or multi-way interface features, may enable navigation, selection, and/or in-focus or partial input selection. Such inputs may correspond to designated inputs which may be associated with active data items, and thus enable or cause programmatic actions associated with such data items. In other variations, mechanical interface features include touch-sensitive pads (e.g. capacitive or resistive), dials, joy-sticks and multi-directional members, roller balls, bezels or other forms of input mechanisms.

Additionally, under one variation, the display may be contact-sensitive (or alternatively light-sensitive) and thus enable interaction with the user. Such interactions may be used to provide any of the designated inputs for causing or enabling programmatic actions such as described.

Applications

Figure 6A:
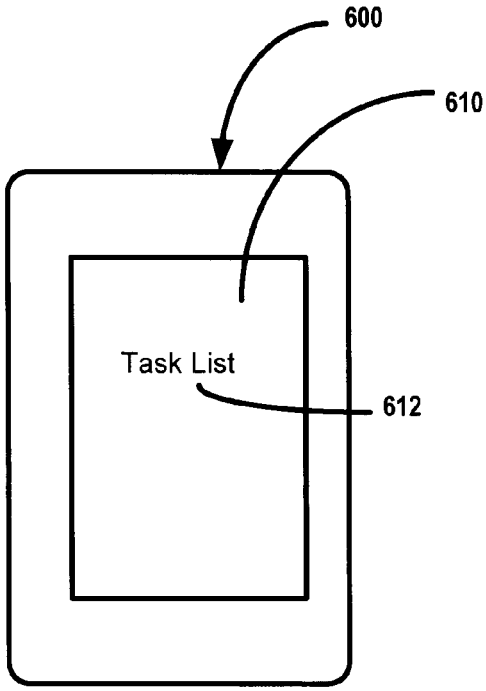
FIG. 6A and FIG. 6B illustrate a computing device display on which a partial display feature is provided, the display being shown in the low and high operational state, in accordance with any of the embodiments described herein.
Figure 6B:
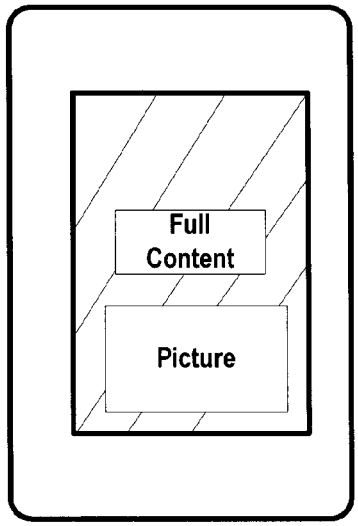

FIG. 6A illustrates an example of a computing device display on which a partial display feature is provided, in accordance with any of the embodiments described herein. A computing device 600 may include, for example, a 320×320 size display screen 610 (although any sized display screen may be used), such as typically provided with many mobile computing devices. The partial display feature may be used to generate display content 612 that requires minimal quality, as measured by contrast or color. The information provided with the display feature may, for example, be coarse or pixilated. In an embodiment, the display content 612 is shown when the device is in a stand-bye mode, with the backlight and refresh operations of the display assembly ceased. In such a state, the display device may be provided in a low operational state (as compared to FIG. 6B, which shows the display surface content in the high operational state).

Numerous examples of the display content 612 may be provided. These include the name and contact information of the owner of the device, a manufacturer logo, a task or calendar entry, information about the last call a person made, or a granulated version of a picture.

Still further, the display content 612 may only occupy a portion of the overall area of the display surface. For example, the display content 612 may be provided where the name and contact information of the user appears, or where the user's task list is provided for a given day. Still further, the specific nature of the display content 612 may be pre-selected (e.g. by region or object) by the user as a setting.

Still further, one embodiment provides for a device to illuminate a monochromatic image when the display assembly is in the low-operational state. For example, data for a designated image (e.g. wallpaper) may be stored each time the device's display assembly is switched into the low operational state. The wallpaper image may then be displayed using data stored in the pixel-level memory cells.

Figure 7:
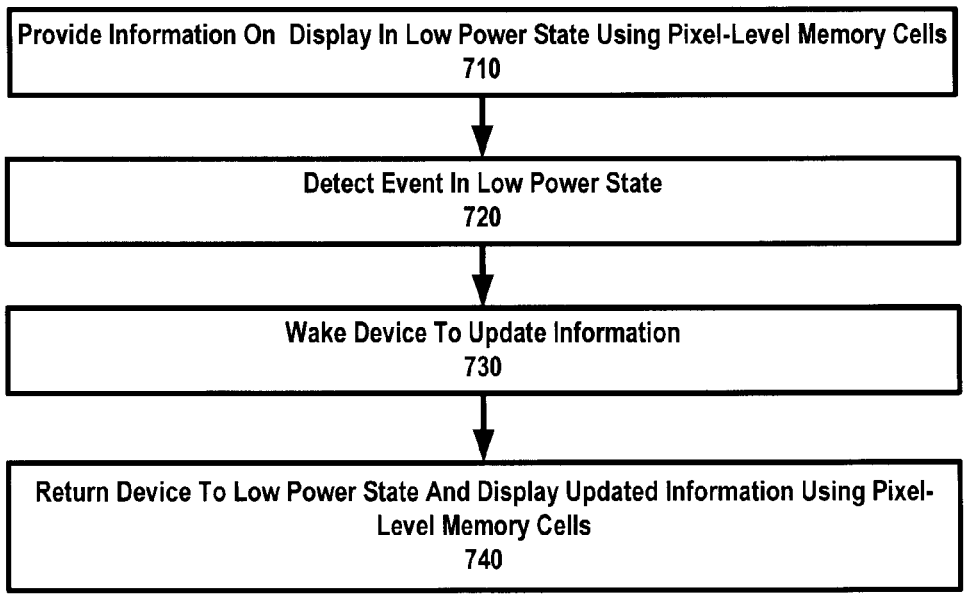
FIG. 7 illustrates another application for use of pixel-level memory cells, under another embodiment of the invention.

FIG. 7 illustrates another application for use of pixel-level memory cells, under another embodiment of the invention. In a method described, the device may be switched from a high operational state to a low operational state. Such a transition may be powered when, for example, a given period of inactivity occurs ("time-out").

Step 710 provides that in the low operational state, the display of the device illuminates information that is designated for display in the low operational state, using data stored in the pixel-level memory cells. Such an illumination may be performed using one or more embodiments described above. The information displayed may correspond to, for example, event information, such as the time of day or a notification generation.

In step 720, the device detects or determines an event that requires or otherwise causes the information being displayed to be updated. This may be an automated or condition/event based response. In an implementation, the information being displayed in the low operational state, and the event may correspond to a change in the unit of time (e.g. change in the minute). In another implementation, the information may be a notification, and the detection may be a change in the notification (e.g. notification is old) or the arrival or triggering of a new notification (e.g, announcement of a new calendar event).

Step 730 provides that the device is awakened to make the update to the information being displayed. In one embodiment, the processor of the device may be awakened so that the display data is refreshed. With the refresh, the data stored in the pixel-level memory may also be refreshed. This data may represent the updated information from the new or modification notification or information item.

Following the refresh, step 740 provides that the display and/or device may return to the low operational state, with the device showing the updated notification or information item.

With an embodiment such as described, a mobile device may display, for example, the time of day on the display screen when the device is powered "off". With the change of a minute (or other measure of time), the device may briefly awaken and change the displayed time. In one embodiment, the awakening of the processor may be performed without powering the display on, so that the device remains relatively dark or otherwise in the low operational state.

Although illustrative embodiments of the invention have been described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mention of the particular feature. Thus, the absence of describing combinations should not preclude the inventor from claiming rights to such combinations.

The invention claimed is:

1. A computing device comprising:

a processing resource;

a display assembly comprising a plurality of pixel elements, wherein the plurality of pixel elements each include a display cell, and wherein the plurality of pixel elements include at least a set of pixel elements that are individually provided with one or more pixel-level memory cells;

wherein the processing resource is configured to write data to refresh the plurality of pixel elements at multiple instances per second when the display assembly is in a high operational state, so as to provide a first display content on the display assembly when the device is in the high operational state;

wherein the set of pixel elements are individually structured to store at least one bit from data written to that pixel element at each of the multiple instances;

wherein when the display assembly is switched from the high operational state to a low operational state, the one or more memory cells of each pixel element in the set are configured so as to carry data representing at least the portion of the data written to that pixel element at a last instance before the display assembly is switched from the high operational state to the low operational state.

2. The computing device of claim 1, wherein the individual pixel elements of the set include a switch element, the switch element being positioned to automatically switch the display cell from receiving data written from the processing resource to using data stored in the memory cell from a last instance when data written to the pixel element was refreshed.

3. The computing device of claim 2, wherein the switch element is positioned to switch the display cell from receiving data written from the processing resource to using data stored in the memory cell from the last instance in response to the display assembly being switched from the high operational state to the low operational state.

4. The computing device of claim 1, wherein each of the plurality of pixels are structured to receive multiple bits of data from the processor at each instance that the processing resource writes the data, and wherein the memory cell of each pixel element of the set is configured to store only a portion of the multiple bits at each of the instances.

5. The computing device of claim 4, the memory cell of each pixel element of the set is configured to store only a single bit of the multiple bits at each of the instances.

6. The computing device of claim 4, wherein each of the plurality of pixels are structured to receive 16 or 24 bits of data from the processing resource.

7. The computing device of claim 1, wherein the set of pixel elements combine to display a low resolution image when the computing device is in a sleep state.

8. A method for operating a computing device, the method comprising:

operating a display assembly comprising a plurality of pixel elements in a high operational state by writing data to the plurality of pixels and refreshing the data at multiple instances per second;

while operating the display assembly in the high operational state, using one or more pixel-level memory cells, provided with each pixel element in a set of pixel elements that comprise at least a portion of the plurality of pixel elements, to store simultaneously, one or more bits of a multi-bit data set that is written to that pixel element from a processor at a most recent instance;

operating the display assembly in a low operational state by displaying a content corresponding to individual pixel elements of the set using the data written from the processor at the most recent instance.

9. The method of claim 8, wherein operating the display assembly in the low operational state includes operating the display assembly to display a low resolution image.

10. The method of claim 8, wherein using the one or more pixel-level memory cells includes storing a single bit from the multi-bit data set at each instance, and wherein operating the display assembly in the low operational state by displaying the content corresponding to individual pixel elements of the set includes displaying the content using the single bit stored with each pixel element from the most recent instance.

11. The method of claim 8, wherein displaying the content corresponding to individual pixel elements is performed automatically in response to the display assembly being switched from the high operational state to the low operational state.

* * * * *

UNITED STATES PATENT AND TRADEMARK OFFICE

CERTIFICATE OF CORRECTION

PATENT NO. : 8,451,202 B2
APPLICATION NO. : 12/042915
DATED : May 28, 2013
INVENTOR(S) : Mostafa Kashi It is certified that error appears in the above-identified patent and that said Letters Patent is hereby corrected as shown below:

In the Claims

In column 11, line 7, in Claim 5, before "the" insert -- wherein --.

Signed and Sealed this
First Day of October, 2013

Teresa Stanek Rea
*Deputy Director of the United States Patent and Trademark Office*